United States Patent [19]

Lepage et al.

[11] 3,942,395

[45] Mar. 9, 1976

[54] APPARATUS FOR REMOVING BOTTLE CAPS

[76] Inventors: Jean-Paul Lepage, 1821, Delorme., Ville de Laval; Jean-Marie Glorieux, 9033, Viau. St Leonard., Montreal, both of Canada

[22] Filed: Aug. 30, 1973

[21] Appl. No.: 393,202

[52] U.S. Cl. ..... 81/3.2

[51] Int. Cl.[2] ..... B67B 7/16

[58] Field of Search ..... 81/3.2, 3.3 A, 3.1 B; 53/381 A

[56] References Cited

UNITED STATES PATENTS

| | | | |
|---|---|---|---|
| 2,386,152 | 10/1945 | Wahl | 81/3.2 X |
| 3,037,407 | 6/1962 | MacLaren | 81/3.2 |

FOREIGN PATENTS OR APPLICATIONS

| | | | |
|---|---|---|---|
| 570,260 | 2/1959 | Canada | 81/3.3 A |
| 496,563 | 7/1954 | Italy | 81/3.1 B |
| 677,454 | 8/1952 | United Kingdom | 53/381 A |

*Primary Examiner*—Al Lawrence Smith
*Assistant Examiner*—Roscoe V. Parker

[57] ABSTRACT

The application discloses an apparatus for removing bottle caps in which a lever is pivotally mounted at one end in a housing in a passageway into which the bottle, of which the cap is to be removed, is inserted. The lever has a cap removing hook intermediate its ends and a spring at the end away from the pivoted end pivots the lever to remove the cap. The lever is moved to spring loaded cap-removing position by a motorized cam having a lever pressing pin at its periphery.

5 Claims, 25 Drawing Figures

FIG. 13
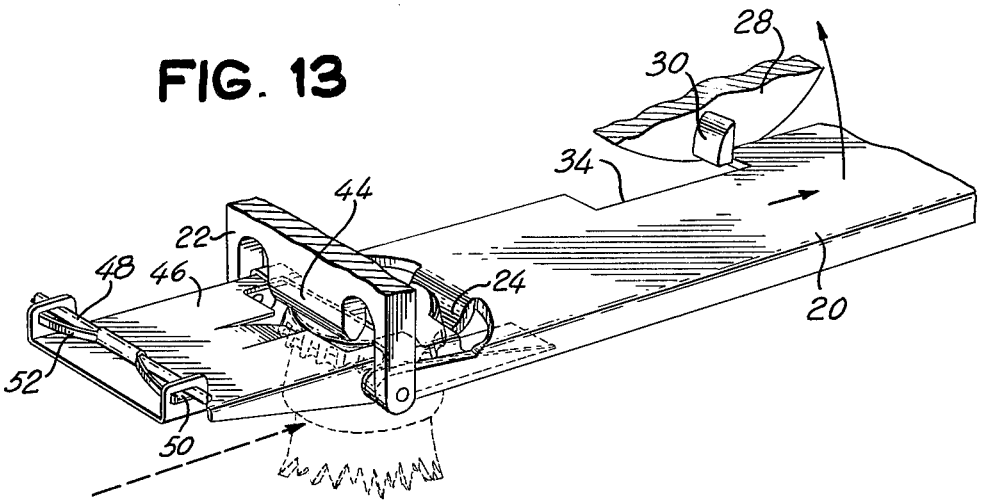
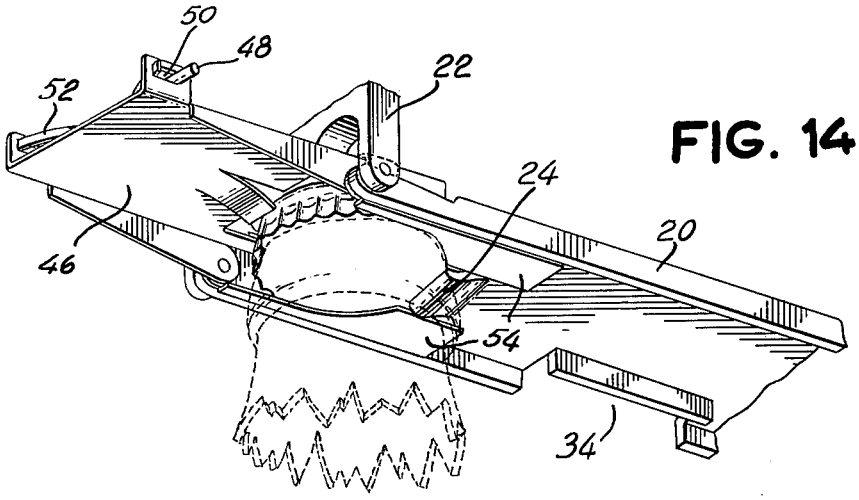
FIG. 14
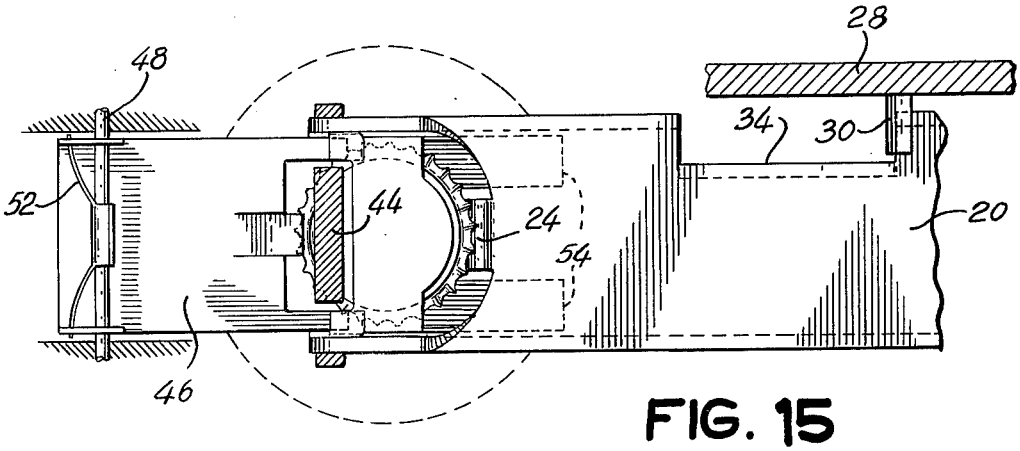
FIG. 15

FIG. 19
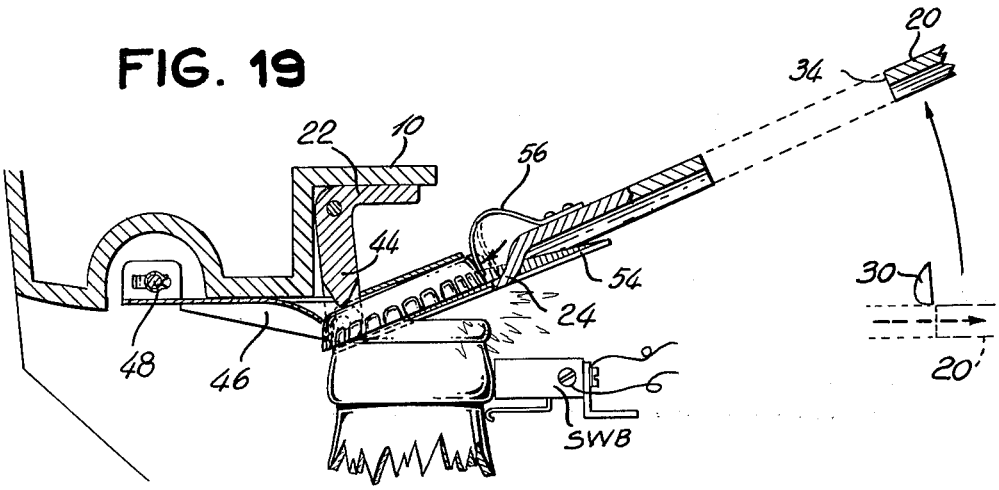
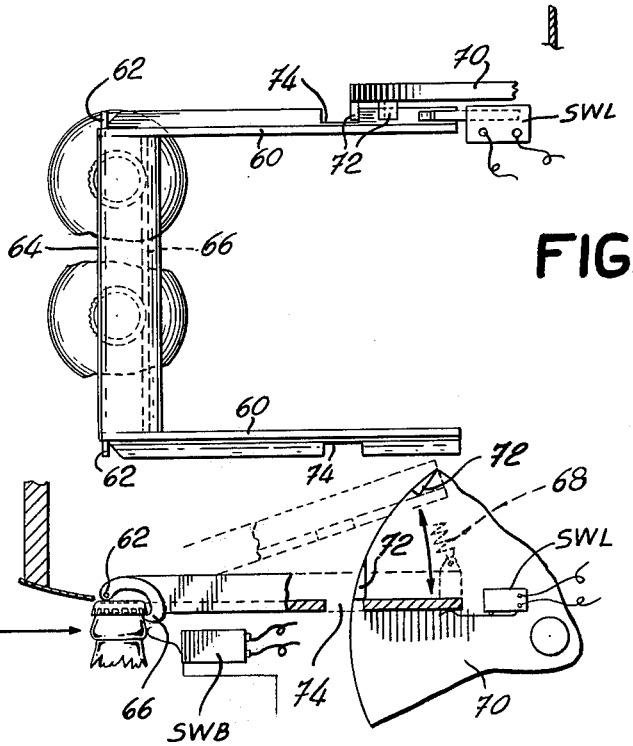
FIG. 21
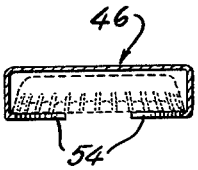
FIG. 20
FIG. 22
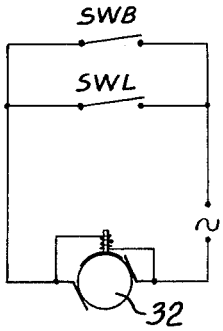
FIG. 23

APPARATUS FOR REMOVING BOTTLE CAPS

This invention relates to an apparatus for removing bottle caps.

It has, up to now, been commonly known to remove bottle caps by means of manually operated bottle openers. These devices usually take the form of a lever provided with a hook which is adapted to engage the rim of the cap and operated with one hand while the bottle is held with the other hand. Another well known type of bottle opener is a small hook which is mounted on a wall. The rim of the cap is engaged underneath such hook while the bottle is pivoted so as to remove the cap. These devices are manual and, consequently, require a fair amount of energy to operate them, more particularly from women and children. They may even become tiresome for men, specially baretenders who have to open a large number of bottles at rush hours. In addition, the manipulation of the bottles during removal of the caps, often causes foaming resulting in spillage of their content.

An object of the invention is therefore to provide an apparatus capable of avoiding the above mentioned disadvantages, which apparatus comprises a housing having a passageway for the manual insertion of a capped bottle of which the cap is to be removed; a lever and means pivotally mounting the lever, at one end, to the housing and in the passageway, the lever having a hook into intermediate the ends thereof located so as to become inserted beneath the rim of the crown cap when the bottle is at the end of the passageway inside the housing. Means is also provided which holds the lever when the bottle is at the end of the passageway to cause pivoting of the lever to remove the cap and to reset the lever when the cap is removed. Finally, further means are provided for holding the bottle steady with respect the housing while the cap is being removed.

The invention will now be disclosed, by way of example, with reference to preferred embodiments thereof and to the accompanying drawings in which:

FIGS. 13 to 15 illustrate various views of a second embodiment of a device for removing bottle caps;

FIGS. 16 to 19 illustrate the operation of the second embodiment of the invention;

FIG. 20 illustrates a section view through a second lever or flap of the second embodiment which is used for holding the caps;

FIG. 21 illustrates a plan view of a lever used in a third embodiment of an apparatus in accordance with the invention;

FIG. 22 illustrates a side view of the lever arrangement of FIG. 21;

FIG. 23 illustrates a diagram of the circuit for operating the motor used for resetting the lever of the mechanism of the apparatus of FIGS. 21 and 22;

Figure 1:
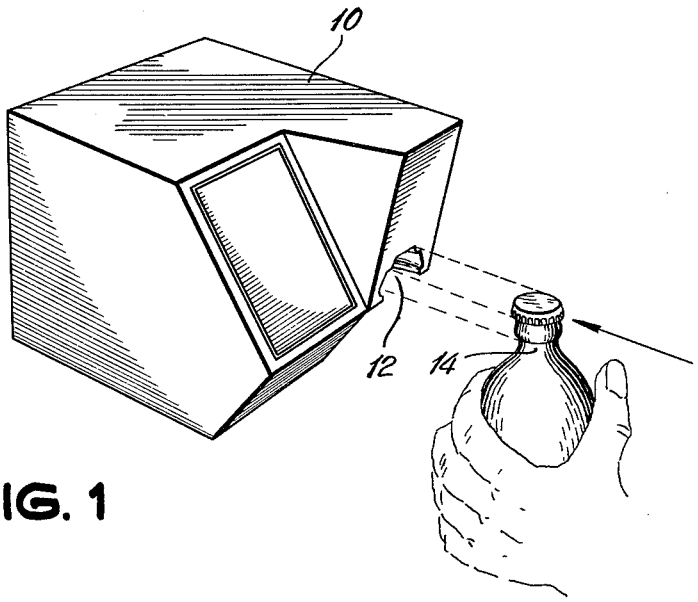
FIG. 1 illustrates a perspective view of the housing of an apparatus for removing bottle caps in accordance with the invention.
Figure 3:
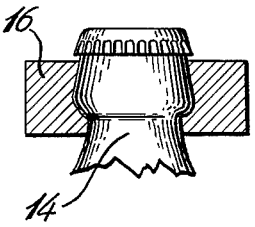
FIG. 3 illustrates a section view of a member for holding the bottles inside the housing.
Figure 2:
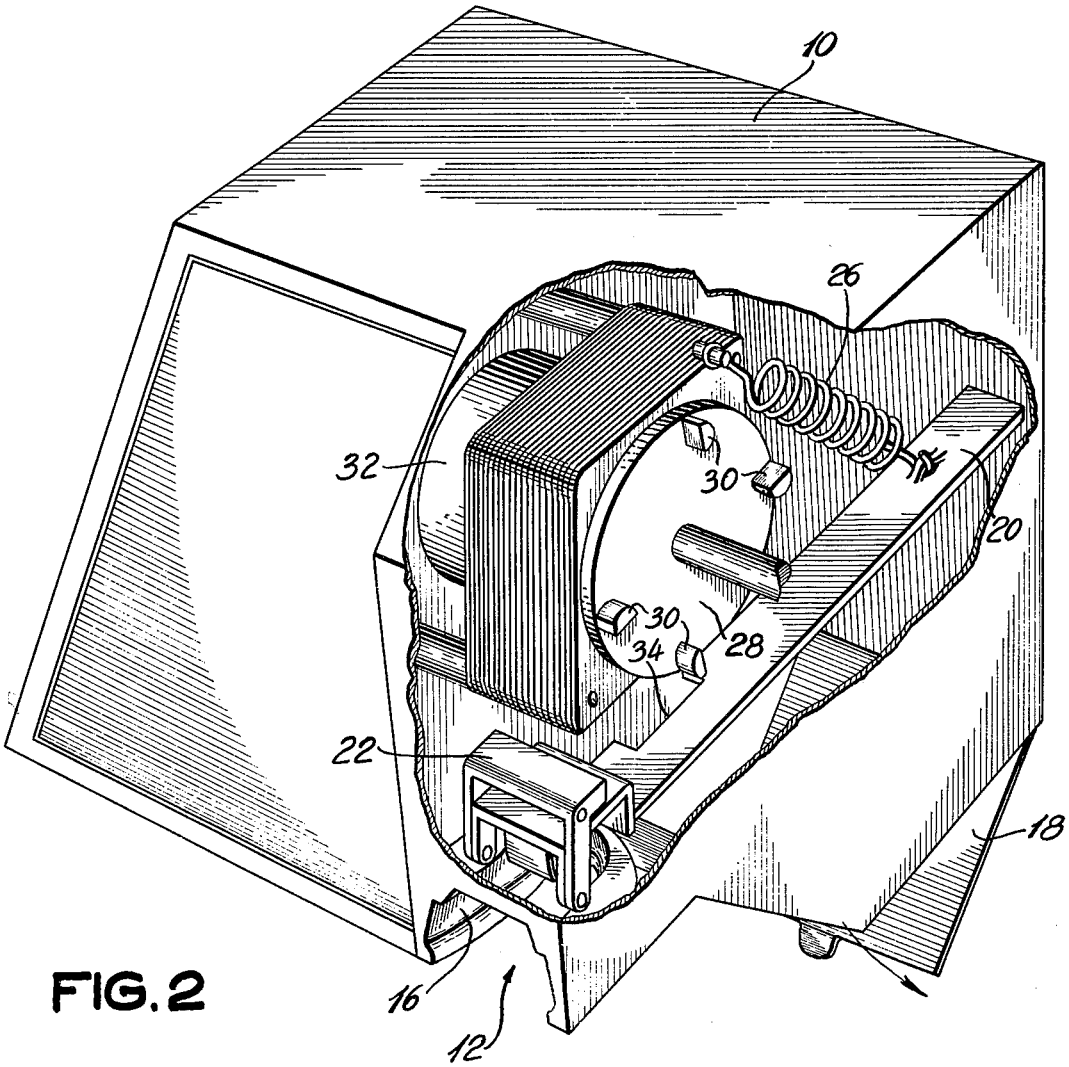
FIG. 2 illustrates the apparatus of FIG. 1 with a portion of the housing cut away to illustrates the mechanism for removing bottle caps.

Referring to FIGS. 1 and 2 there is shown a first embodiment of an apparatus for removing bottle caps. Such an apparatus is inclosed in a housing 10 having a passageway 12 for receiving the neck of a bottle 14. A member 16 is secured to the housing 10 and made integral therewith for holding the bottles by the neck. As illustrated more clearly in FIG. 3, such member has a configuration such as to closely conform to the shape of the neck of the bottle. The bottom of the housing is provided with a door 18 which may be opened for picking up the bottle caps which as it will be disclosed later, are ejected towards the bottom of the housing after having been removed from the bottles.

Figure 4:
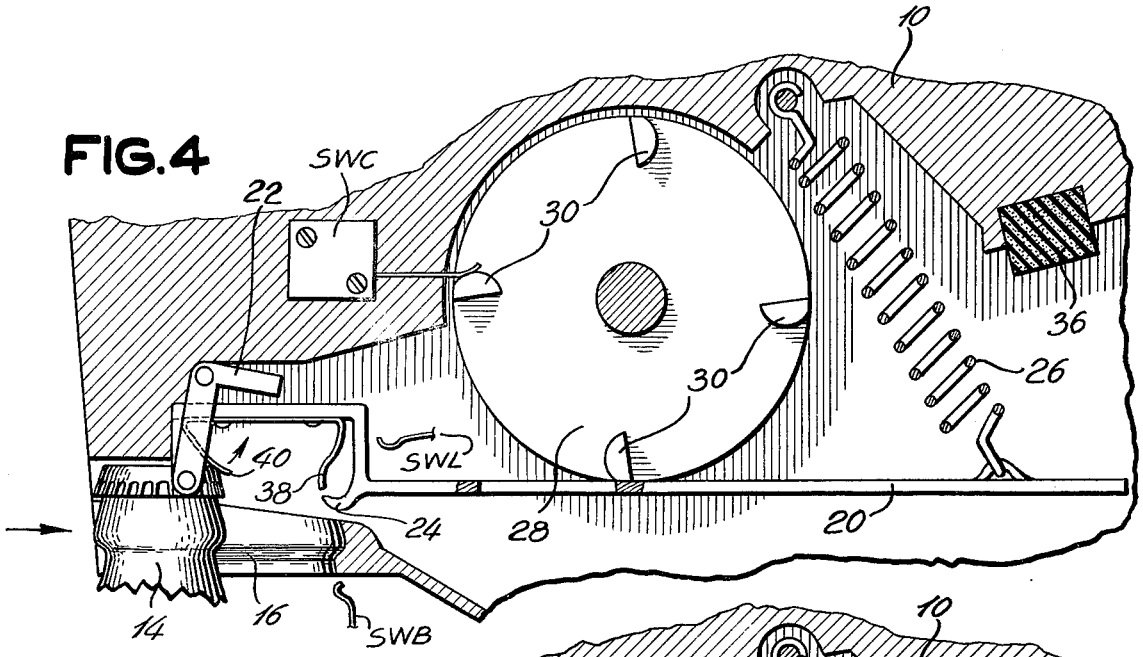
FIGS. 4 to 8 illustrate the operation of the mechanism of FIG. 2.

As illustrated more clearly in FIG. 4, the mechanism for removing the bottle caps comprises a lever 20 which is pivotably mounted at one end to an L-shaped bracket 22 itself pivotably mounted on the housing 10. This arrangement allows limited axial displacement of the lever 20. The latter is provided with a hook 24 adapted to engage underneath the rim of the bottle caps for removing the cap when the lever is operated. The lever 20 is operated by a spring 26 attached at one end to the housing 10 and at its other end to the end of the lever which is remote from the hook 24. The lever 20 is reset into inoperative position against the action of spring 26 by means of a cam 28 having at least one peripheral pin 30 thereon adapted to engage the lever. The cam 28 is rotated by an electric motor 32 the operation of which is controlled by switches SWB, SWC and SWL which are operated respectively by the bottle, the cam and the lever, the circuitry being shown in the electrical diagrams of FIGS. 9 to 12.

The operation of the apparatus so far disclosed is as follows, referring the FIGS. 4 to 12 of the drawings. In the first position illustrated in FIGS. 4 and 9 of the drawings the spring 26 is tensioned by pin 30 of cam 28 which bears against lever 20 holding it down. Since the spring 26 is at an acute angle with the lever, such lever is beared to the left forcing the vertical portion of L-shaped bracket 22 to engage the housing.

Figure 5:
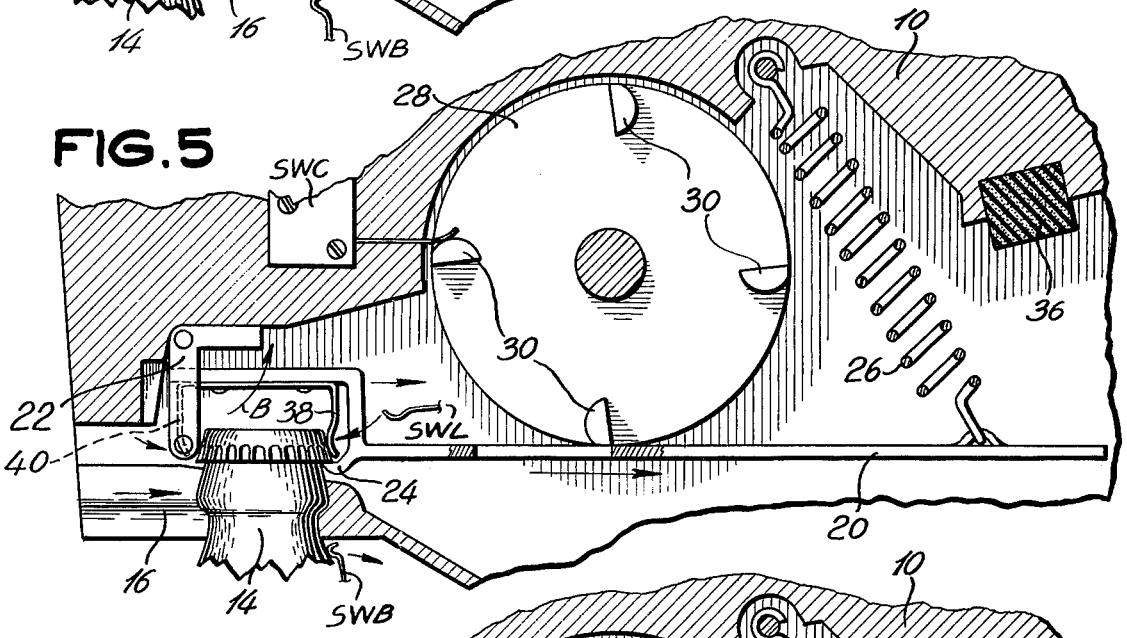
Figure 6:
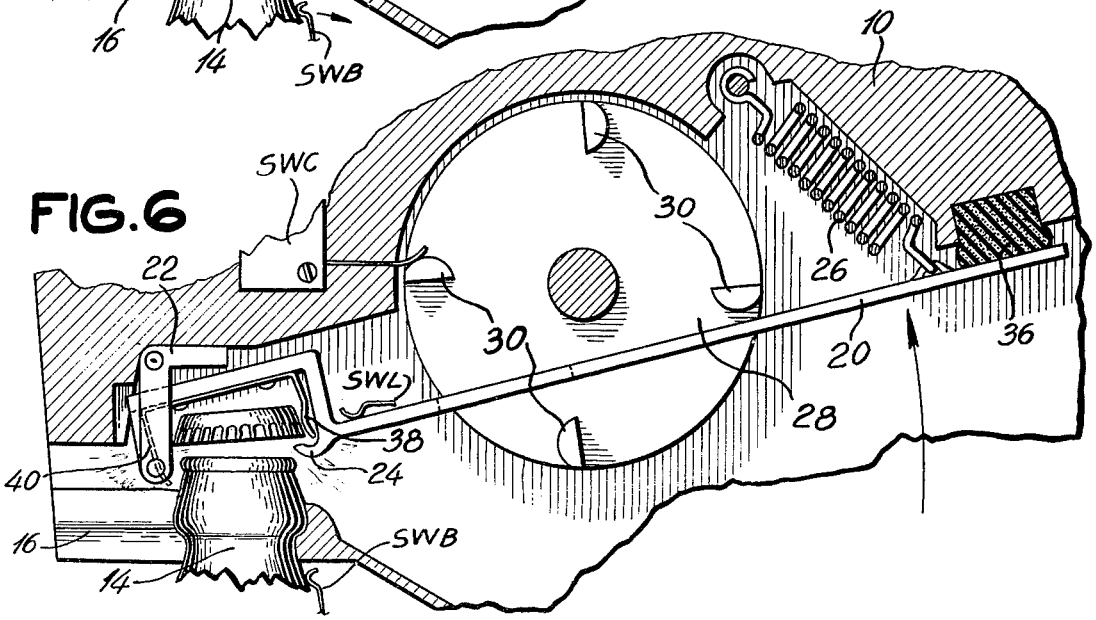
Figure 10:
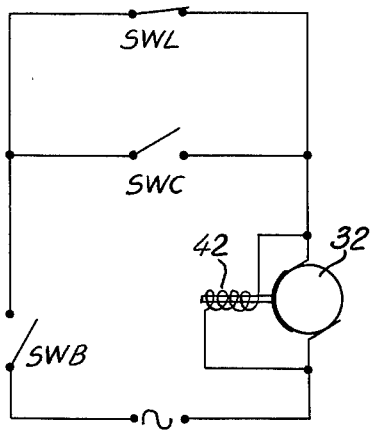

When the bottle is pushed into slot 12 and the finger 24 engages the neck of the bottle underneath the edge of the cap, the lever 20 is moved to the right as indicated by the arrow A in FIG. 5 and switch SWB is opened, FIG. 10. The distance travelled by the lever 20 is limited by the horizontal portion of the L-shaped bracket 22 which is adapted to contact the housing after having pivoted as indicated by arrow B. The movement of lever 20 to the right causes the pin 30 of cam 28 to move into a slot or cut-out 34 provinding a through aperture in the lever 20 and the latter thus becomes free to move upwarly under the action of spring 26 as indicated by arrow C in FIG. 6. In so doing the cap of the bottle will be removed. It is understood that, during such operation, the bottle does not move because it is held by member 16 which conforms to the shape of the neck of the bottle. This will therefore prevent foaming. The upward movement of lever 20 is arrested by a damper 36.

Figure 7:
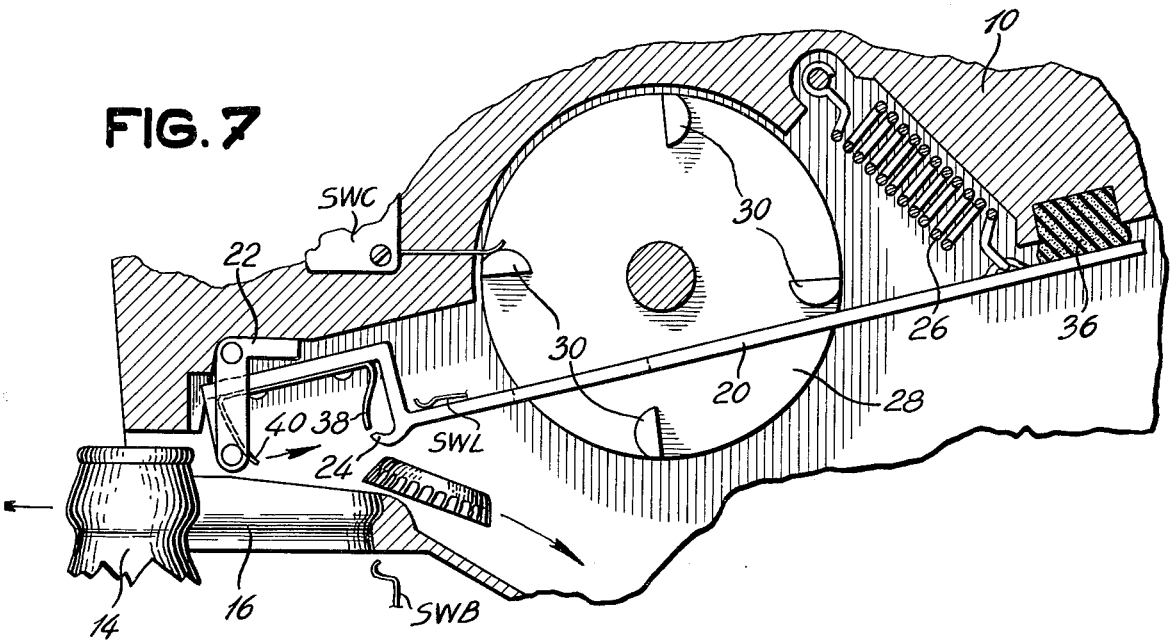
Figure 8:
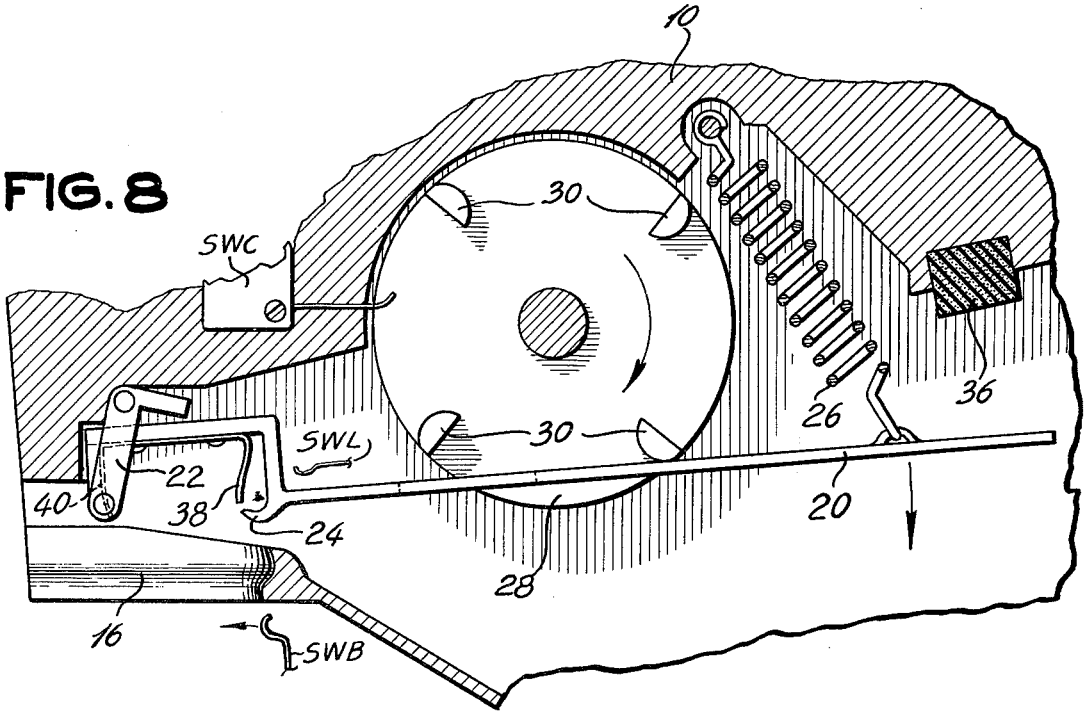

When the bottle cap is removed from the bottle it is pushed away from the hook 24 by means of a spring 38 located adjacent hook 24 and is ejected towards the bottom of the housing 10 by means of another spring 40 located opposite spring 38 as illustrated in FIG. 7 of the drawings.

Figure 11:
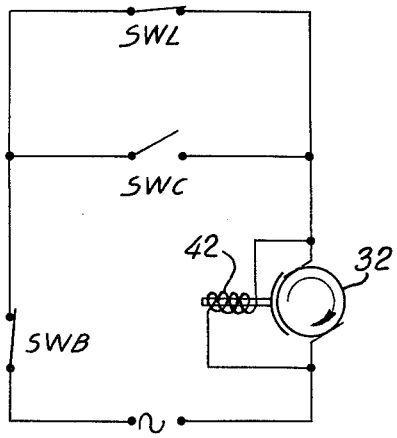
Figure 12:
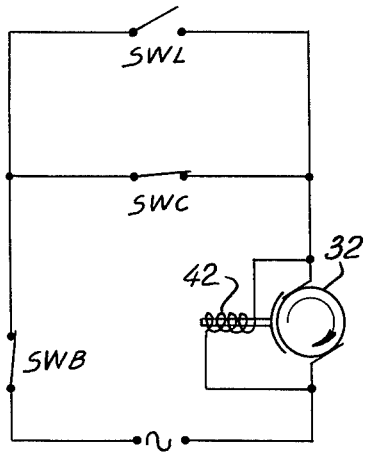

When lever 20 reaches its upward position switch SWL is closed as illustrated in FIG. 10 of the drawings and, when the bottle is removed, switch SWB is again closed, as illustrated in FIG. 11 to operate motor 32 through energization of the coils 42.

Figure 9:
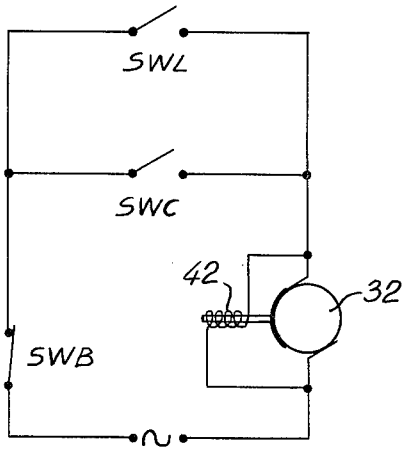
FIGS. 9 to 12 are electrical diagrams illustrating the operation of the various limit switches controlling the operation of the motor operating the cam which reloads the lever of the mechanism for removing bottle caps.

The energyzation of motor 32 causes the rotation of cam 28 and pin 30 moves the lever 20 against the action of spring 26. The motor is maintained energized by switch SWC which is closed as soon as pin 30 moves past it (see FIGS. 8 and 12.) The following pin 30 eventually opens the switch SWC and deenergizes the motor (FIGS. 4 and 9.). The motor 32 is equipped with an electromagnetic brake which is released when the motor is energized and stops the motor as soon as the latter is deenergized. The cam 28 thus immediately stops the moment the switch SWC is opened by pin 30 in the position shown in FIG. 4 of the drawings.

It is to be understood that the cam 28 does not require more than one pin 30 to return the lever 20 to its rest position. The switch SWC would then be operated by the same pin 30 which moves the lever 20. However it is more convenient to have plural pins so as to limit the angle of rotation of the cam and thus the time required to return the lever 20 to its rest position.

The present invention is not limited to the arrangement above disclosed. Other arrangements are also contemplated such as the one illustrated in FIGS. 13 to 20. In this embodiment, the lever 20 is identical to the one of the first embodiment except that L-shaped bracket 22 is provided with an abutment 44 which is adapted to contact the top of the bottle prior to removal of the cap and performs the same function as the member 16 of the first embodiment, that is the function of holding the bottle down when the lever 20 is pivoted upwardly.

Of course, abutment 44 bears against the edge of the bottle cap which is opposite to the one engaged by the hook 24 as to provide a fulcrum for lever 20.

The arrangement of FIGS. 13 to 20 is provided with a second lever or flap 46 for guiding the bottle which flap, as best seen in FIG. 15, pivots around a shaft 48 in the housing. Because flap 46 has to move with lever 20 during insertion of the bottle, slots 50 are provided in the flap 46 so that it can slide with respect to shaft 48. A spring 52 biases the flap 46 to its rearward position, as illustrated in FIGS. 13 to 15. As best seen in FIGS. 14 and 20, flap 46 is provided with two inturned cap guiding portions 54 adapted to engage underneath the rim of the caps so as to guide the bottles prior to removing the caps. The flap 46 is also made in two portion which are pivoted at the same point as lever 20, so as to permit the portion of the flap holding the caps to follow the movement of lever 20 during opening of the bottles as illustrated in FIG. 19.

Figure 16:
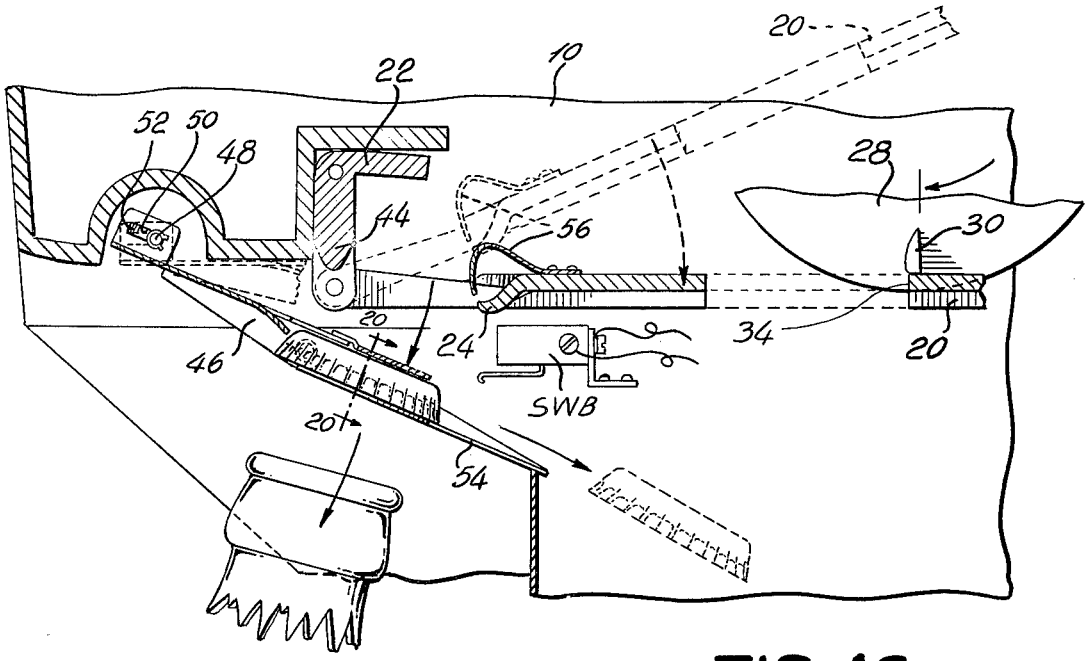
Figure 17:
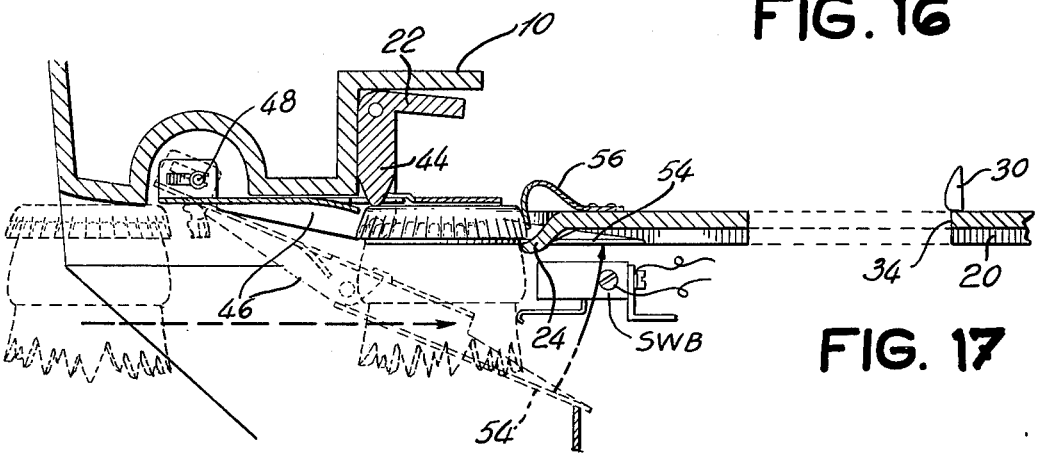
Figure 18:
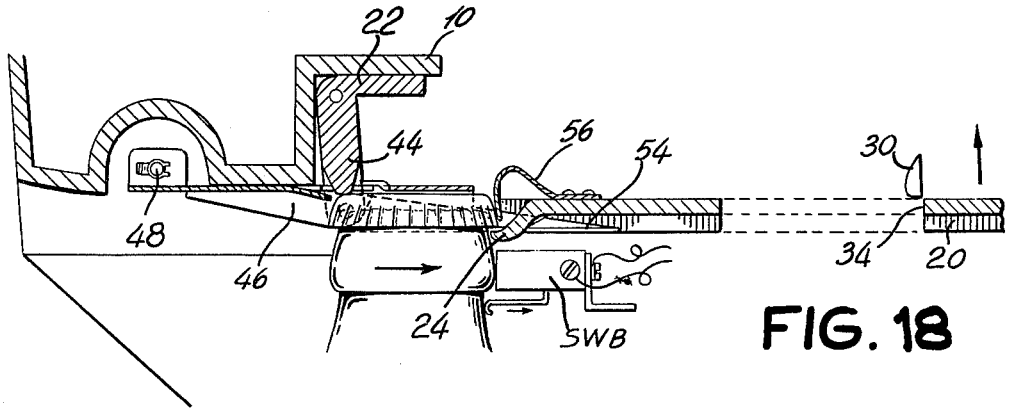

When the caps are removed from the bottles, the latter are freed and the caps are moved from underneath hook 24 by means of a spring 56 as illustrated in FIG. 19. The flap 46 thus falls down as illustrated in FIG. 16 and the caps slide automatically towards the bottom of the housing 10.

In the arrangement of FIGS. 13 to 20, the lever 20 is operated in the same way as in the first embodiment and reset by a cam 28 which is also identical to the one of the first embodiment.

It is to be understood that, any type of lever arrangement is contemplated for opening the bottles. Another lever arrangement is illustrated in FIGS. 21 and 22 of the drawings and includes two legs 60 which are pivoted at 62 and include transverse portion provided with a fulcrum 64 which bears against the bottle caps and a hook 66 which is adapted to contact the rim of the caps. The transverse portion of the lever arrangement is wide enough so as not to require accurate positioning of the bottles.

The lever arrangement of FIGS. 22 and 23 is operated by a spring 68 and reset by a cam 70 which is slightly different from the one of the provious embodiments, the area of rotation of cam 70 is slighty lower than lever 60 when in its rest position and the downward movement of lever 60 is arrested by switch SWL (FIG. 23), just before tooth 72 falls into slot 74 of the lever. When a new bottle is placed into the housing, switch SWB is operated to start the motor and tooth 72 fails in slot 74. Lever 60 is therefore freed and is moved upwardly by spring 68 to open the bottle.

Figure 24:
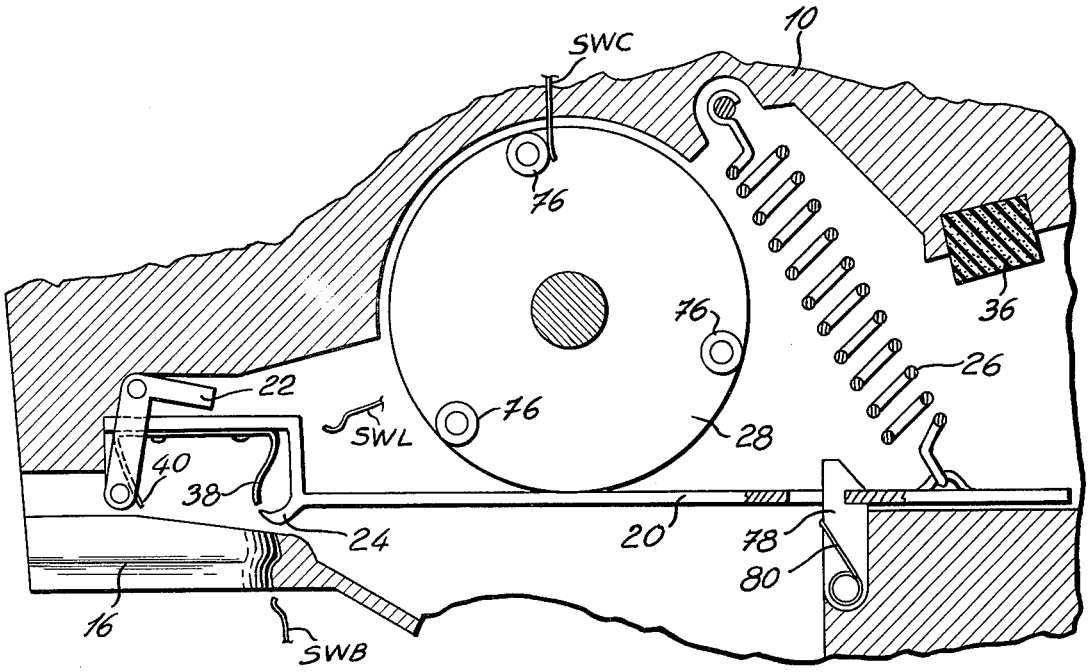
FIG. 24 illustrates a fourth embodiment of an apparatus for removing bottle caps.

FIG. 24 shows another alternative embodiment of the invention wherein the arrangement for resetting lever 20 is different from the ones of the previous embodiment. Here the cam 28 is provided with pins 76 which simply move the lever 20 down and the motor 32 does not have to be equipped with an electromagnetic brake for stopping the cam 28 at a precise position. In this embodiment the lever 20 is held in its rest position by means of a catch 78 biased by a spring 80. The motor 32 is energized and deenergized by a circuit arrangement identical to the one shown in FIGS. 9 to 12.

Figure 25:
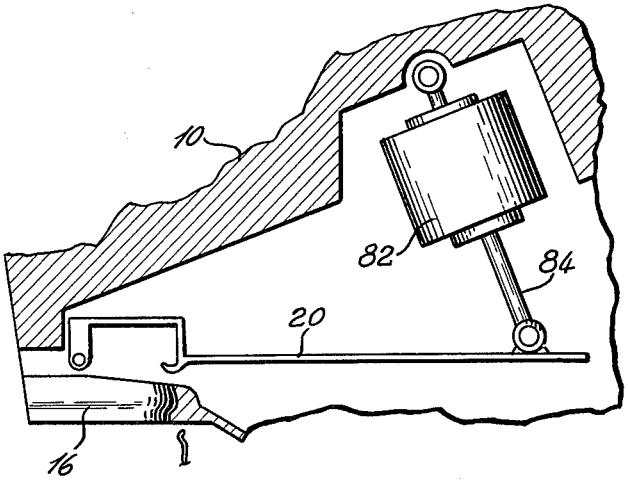
FIG. 25 illustrates a fifth embodiment of an apparatus in accordance with the invention.

FIG. 25 illustrates another embodiment of an apparatus in accordance with the invention wherein the lever 20 is operated by a solenoid 82 having a portion 84 attached thereto. Means (not shown) may be provided for operating the solenoid when the bottles are fully inserted into the member 16 of the housing 10. Such means may be energized by switch SWB which is adapted to contact the side of bottles.

Although the invention has been disclosed with reference to preferred embodiments thereof, it is to be understood that these embodiments have been described by way of example only and that the scope of the invention is to be limited by the claims only.

We claim:

1. An apparatus for removing the crown cap of a capped bottle, said apparatus including a housing defining an inner chamber and having a passageway into which said capped bottle is to be inserted, said passageway opening into said chamber, comprising:

A. a cap removing lever extending from said passageway into said chamber and means mounting one end of said lever inside said passageway for pivotal movement about an axis transverse to said lever, said lever having a cap removing hook intermediate its other end and its pivotal axis;

B. a second lever pivotally mounted in said passageway and having in-turned flanges to engage under the rim of said cap when said bottle is inserted in said passageway so as to retain said cap after it is removed from said bottle, said second lever being pivotable downwardly when the uncapped bottle is removed said second lever formed to allow said cap to slide freely under its own weight towards the inside of said housing; said second lever being made of two portions pivoted to one another, one pivoted also to said housing and the other carrying said flanges and pivoting with said lever when said cap is removed;

C. an L-shaped bracket pivotally mounted at the apex thereof to said housing and movable between active and inactive positions where the legs of said bracket alternately abut said housing, said cap-removing lever being pivoted at one end of one of said legs;

D. a biasing member attached at one end to said housing and at the other end to said lever said biasing member being inclined to bias said lever to said inactive position of said bracket which corresponds to a reset position of said cap-removing lever;

E. said L-shaped bracket formed with a downwardly projecting abutment member to engage the top of said bottle cap at a point thereof opposite that where said hook is engaged so as to provide a fulcrum for the cap-removing lever when pivoted for removing the cap;

F. said cap-removing lever having a through aperture between said hook and said other end thereby enabling said L-shaped bracket to allow limited axial displacement of said cap-removing lever;

G. a rotary cam having at least two peripheral pins of which one is engageable, upon rotation of said cam, with said cap-removing lever to pivot it to reset position against the biasing action of said biasing member, said pin resting on the edge of said cap-removing lever aperture in said reset position; and H. an electrical circuit comprising:

1. a motor for rotating said cam;

2. a normally closed bottle switch to be opened by said bottle as the latter reaches the inner end of said passageway and said cap is engaged by said hook, further movement of said bottle in said passageway displacing said cap-removing lever axially causing said one cam pin to fall in said aperture to release said lever an to allow said biasing member to pivot said lever to thus remove said cap;

3. a normally opened lever switch closing upon being hit by said cap-removing lever after pivotal thereof by the action of said biasing member; the closing of said bottle switch when said bottle is removed and the closing of the lever switch energizing said motor causing rotation of said cam;

4. a cam switch opened by the other of said cam pins when said cap-removing lever is in said reset position, said cam switch closing when said cam starts rotating and being opened again where hit by said one pin thereby opening said circuit and deenergizing said motor.

2. An apparatus as defined in claim 1, wherein said switch means comprises a pair of switches mounted in parallel, one switch being responsive to the insertion of said bottle in said passageway for energizing said motor and cause said pin to desengage said lever so as to permit said lever to pivot under the action of said spring and remove said cap from said bottle.

3. An apparatus as defined in claim 1, wherein said lever is pivotally mounted to a bracket member which is itself pivotally mounted on said housing so as to permit relative movement of said lever with respect to said locking means, and further comprising biasing means for biasing said bracket to rest position, said lever being moved by said bottle when inserted in the housing against the action of said spring so as to desengage said locking means from said lever and permit the spring to pivot said lever and thus remove said cap.

4. An apparatus as defined in claim 1, wherein said biasing member for pivoting said lever is a solenoid.

5. An apparatus as defined in claim 1, wherein said biasing member is a spring.

* * * * *